US005314177A

United States Patent [19]

Anma

[11] Patent Number: 5,314,177

[45] Date of Patent: May 24, 1994

[54] SHEET STACKING APPARATUS

[75] Inventor: Hideyuki Anma, Yokohama, Japan

[73] Assignee: Kabushiki Kaisha Toshiba, Kawasaki, Japan

[21] Appl. No.: 921,753

[22] Filed: Jul. 30, 1992

[30] Foreign Application Priority Data

Jul. 31, 1991 [JP] Japan ..... 3-192212

[51] Int. Cl.[5] ..... B65H 1/06

[52] U.S. Cl. ..... 271/3.1; 271/215; 271/217; 271/220

[58] Field of Search ..... 271/3.1, 215, 217, 220

[56] References Cited

U.S. PATENT DOCUMENTS 4,552,351 11/1985 Tsukamoto ..... 271/3.1

4,747,492 5/1988 Saito ..... 271/218 X

*Primary Examiner*—Richard A. Schacher

*Attorney, Agent, or Firm*—Cushman, Darby & Cushman

[57] ABSTRACT

A sheet stacking apparatus has a shutter mechanism, having a shutter, for controlling the stacking and dropping operations of sheets to be stacked in a stacking safe. When a sensor detects that the sheets to be stacked on the shutter have been stacked to reached a predetermined height, the shutter is moved downward to reserve a space in the vicinity of a sheet loading port, and is opened to cause the sheets to drop onto the lower portion of the stacking safe. Then, the shutter is moved upward to the home position to stack the sheets thereon. When these shutter downward and upward movements are repeatedly performed, stacking can be performed stably, and the sheets discharged from the lower bottom of the stacking safe can be collected in the upper portion of the stacking safe through a communication path outside the stacking safe, thereby continuously performing a series of sheets loading and discharge operations.

1 Claim, 19 Drawing Sheets

SHEET STACKING APPARATUS

BACKGROUND OF THE INVENTION

1. Field of the Invention

The present invention relates to a sheet stacking apparatus incorporated in, e.g., an automatic teller machine of a financial agency such as a bank and used to stack banknotes and the like.

2. Description of the Related Art

In an apparatus of, e.g., an automatic teller machine which receives sheets, e.g., banknotes one by one and stores them in the stacking state, the depth of the sheet stacking section serves as a factor to largely influence the performance of the apparatus.

More specifically, if the stacking section is excessively shallow, the trailing end of a sheet previously received and the leading end of a sheet to be received next collide; if the stacking section is excessively deep, the sheets are not set horizontally but rise to cause erroneous stacking.

Conventional stacking apparatuses of this type can be divided into a fixed depth-type stacking apparatus in which the stacking bottom surface of the sheet stacking section is fixed and a variable depth-type stacking apparatus in which the stacking bottom surface is controlled to move downward in accordance with the number of sheets that are to be received and stacked.

In such a conventional stacking apparatus in which the depth of the sheet stacking section is fixed, however, the stacking depth capable of appropriate stacking sheets is limited, and thus the number of sheets to be stacked is small.

Furthermore, in order to handle a maximum number of sheets by using the fixed depth-type apparatus, a cumbersome operation of temporarily storing a predetermined number of sheets at some place and transferring them to another stacking place, and receiving the remaining sheets must be repeated. This operation complicates the apparatus and degrades the handling efficiency.

On the other hand, a variable depth-type apparatus can handle a large number of sheets if the quality of the sheets is the same and comparatively good. However, assume that the quality of the sheets is poor, i.e., used sheets are to be handled. Since used sheets have various thicknesses, as the number of stacked sheets is increased, the stacked sheet height varies even if the number of stacked sheets is the same as the good-quality sheets. The height of the poor-quality stacked sheets can reach to about five times that of the good-quality stacked sheets. Since the conventional apparatuses cannot cope with a change in stacking depth caused by the different sheet qualities, they cannot maintain the optimum sheet stacking depth, and their performance varies. In particular, in a spring-type sheet stacking apparatus, since the operation varies, the stacking depth is not changed with a small weight change.

This fact will be described in more detail.

FIGS. 1 and 2 show an arrangement of a banknote stacking means of a conventional banknote stacking apparatus. The operation of a shutter 204 is controlled in accordance with the number of banknotes A stacked on it. As described above, if the banknotes have a poor quality, they cannot be sufficiently pushed by a striker wheel 203 even at a stacking depth that might have been appropriate for good-quality banknotes, as shown in FIG. 1. In this case, the banknotes A rise to interfere with insertion of a following banknote A, thus causing jamming.

Inversely, with new banknotes, if the stacking depth is excessively large, as shown in FIG. 2, the banknotes rise to cause jamming.

In this manner, the conventional banknote stacking means cannot sufficiently cope with a difference in stacking height due to the quality of the banknote, and continuous banknote stacking cannot be stably performed.

Hence, a method as shown in FIG. 3 is employed. According to this method, when a certain number (relatively small) of banknotes, e.g., about 100 banknotes A are stacked on the shutter 204, loading of the banknotes is temporarily stopped. A pusher 207 is moved downward to a position below the support positions of upper press plates 205 to push the banknotes A stacked on the shutter 204, and thereafter the pusher 207 is moved upward to the home position. After these series of storing operations, loading of the banknotes A is resumed. With this method, however, the handling time is prolonged very much.

In addition, with the conventional banknote stacking means, has no effective apparatus for performing a continuous stacking operation in which, while the banknotes are loaded in a stacking safe from above, the stacked banknotes are unloaded from below the stacking safe.

SUMMARY OF THE INVENTION

The present invention has been made in view of the conventional situation described above, and has as its object to provide a sheet stacking apparatus capable of performing stacking handling in a good state by maintaining an optimum stacking depth in a sheet stacking safe regardless of the quality of the sheets, e.g., banknotes, and reducing variations in performance, and continuously performing a series of stacking operations of loading and unloading.

In order to achieve the above objects, according to the present invention, there is provided a sheet stacking apparatus comprising:

stacking means, having a sheet loading port, for stacking sheets loaded through the sheet loading port;

separation means, provided inside the stacking means, for separating the sheets stacked on the stacking means from sheets newly loaded through the sheet loading port and for stacking the newly loaded sheets thereon;

urging means for urging the sheets which are being stacked on the separation means such that those ends of the sheets which are closer to the sheet loading port are directed in a stacking direction;

detection means for detecting a position of those portions of the sheets which are urged by the urging means; and means for moving the separation means in the stacking direction on the basis of detection results of the detection means, thereby allowing the sheets stacked on the separation means to be unchanged in position.

With the above arrangement, in the sheet stacking apparatus of the present invention, when the detecting means detects that the banknotes stacked on the shutter movable in the direction perpendicular to the sheet surface of the sheets stacked in the stacking safe have reached the predetermined height, the shutter is moved downward to reserve a stacking space near the sheet loading port of the stacking safe, and the shutter is opened to cause the sheets to drop onto the lower portion of the stacking safe. Then, the shutter is moved upward to the home position to allow banknotes to be stacked thereon. When these shutter downward and upward operations are repeatedly performed, a large number of sheets can be stacked and handled regardless of the quality of the sheets.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

A preferred embodiment of the present invention will be described with reference to the accompanying drawings.

Figure 1:
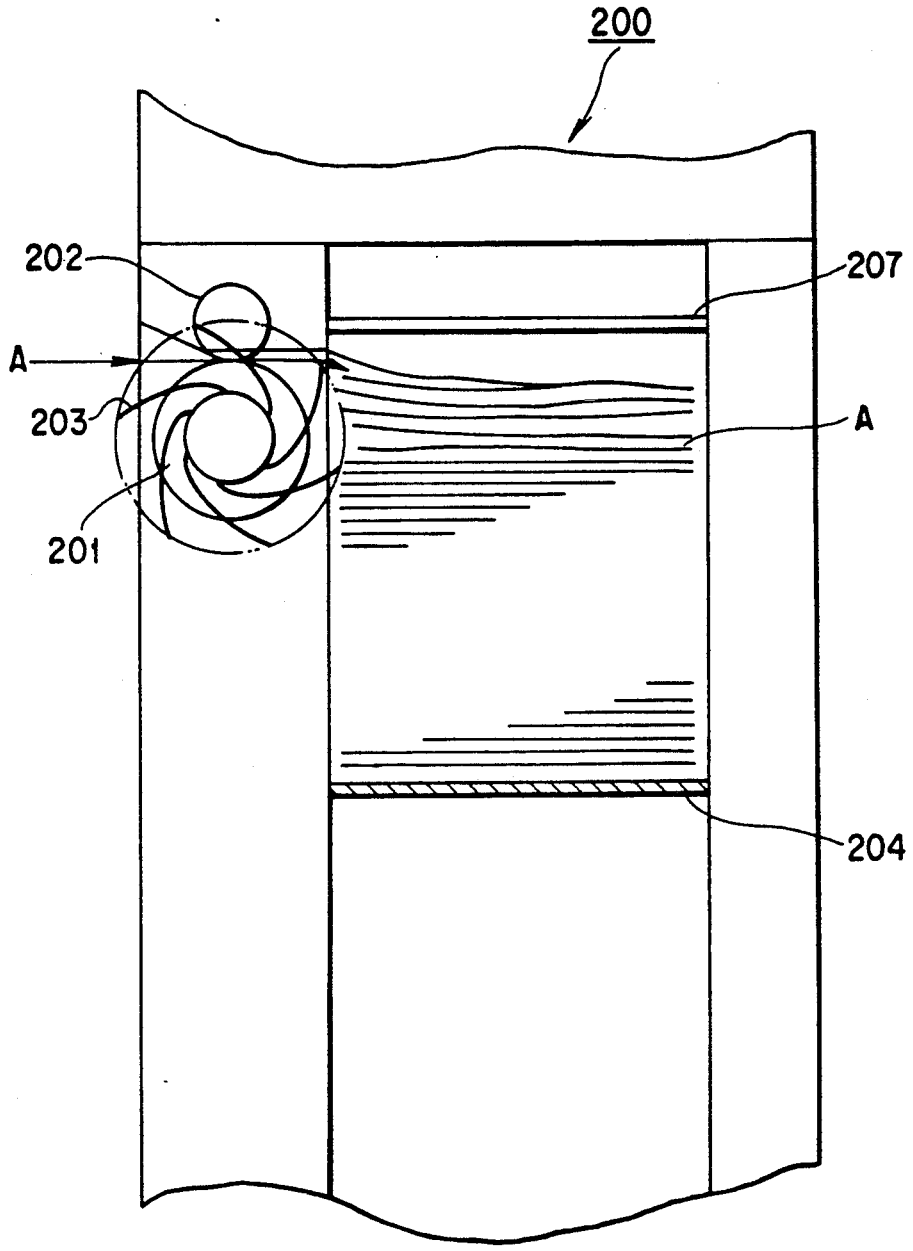
PRIOR ART FIG. 1
FIG. 1 is a view schematically showing a stacking control state of a conventional sheet stacking apparatus.
Figure 2:
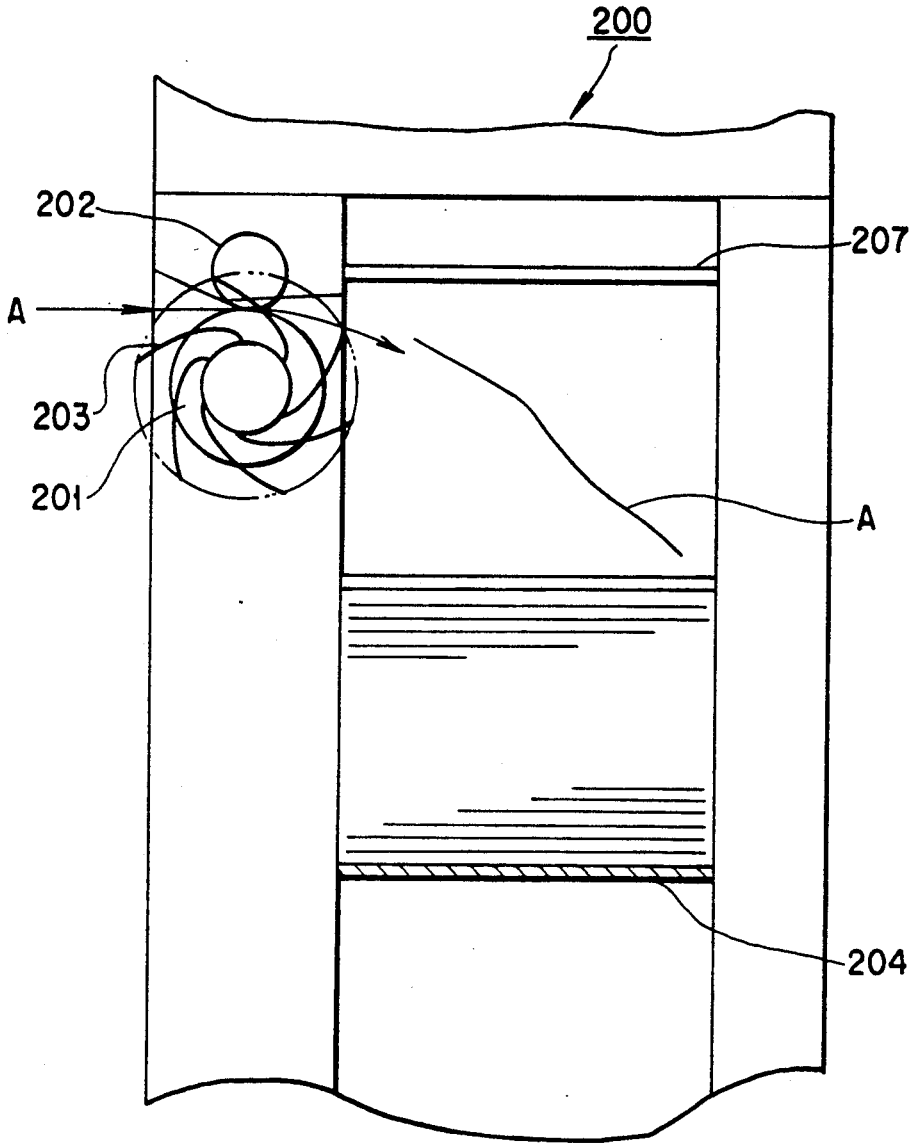
PRIOR ART FIG. 2
FIG. 2 is a view showing another stacking control state of the conventional sheet stacking apparatus.
Figure 3:
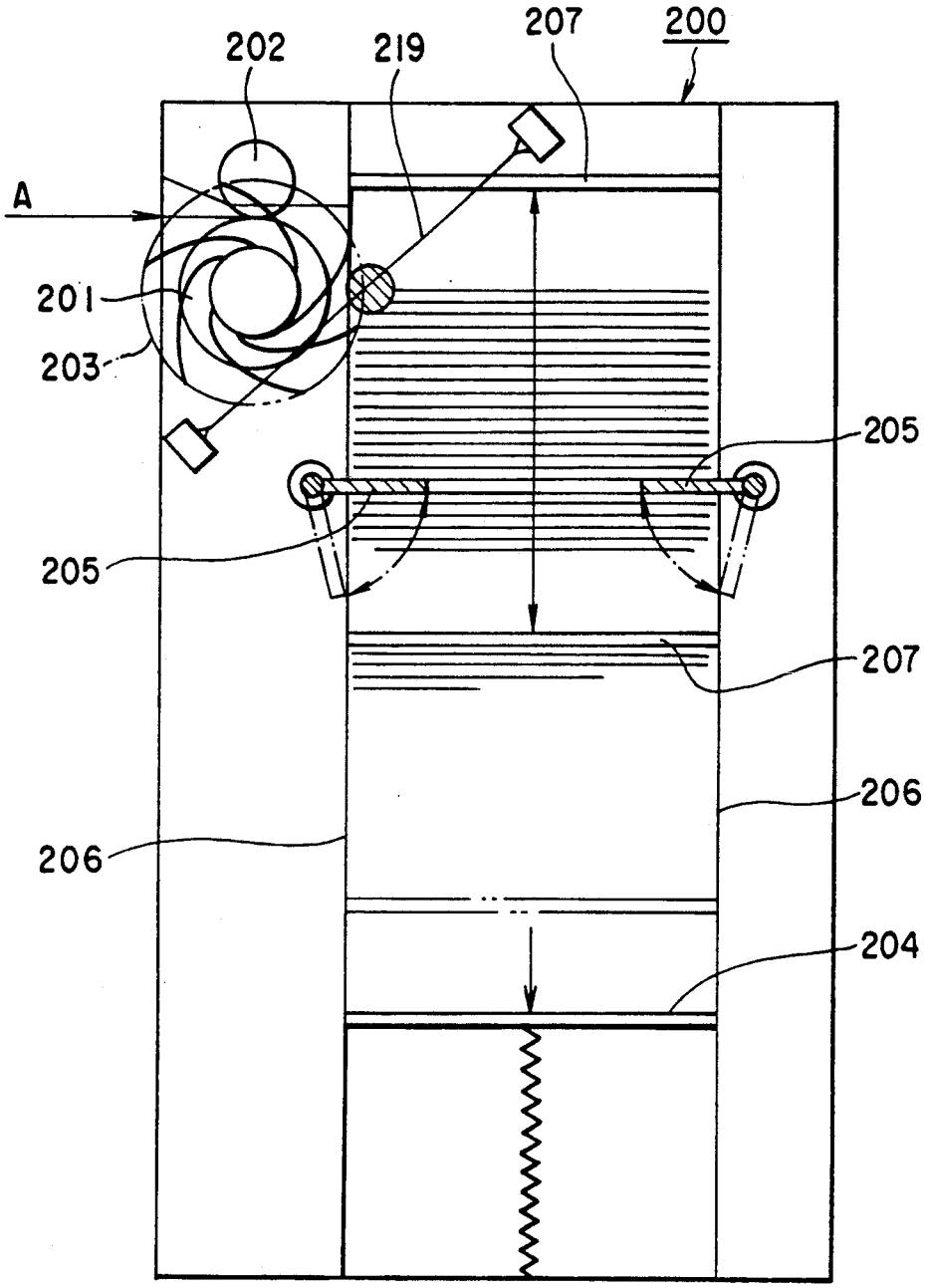
PRIOR ART FIG. 3
FIG. 3 is a view showing a schematic arrangement of another conventional sheet stacking apparatus of this type.
Figure 4:
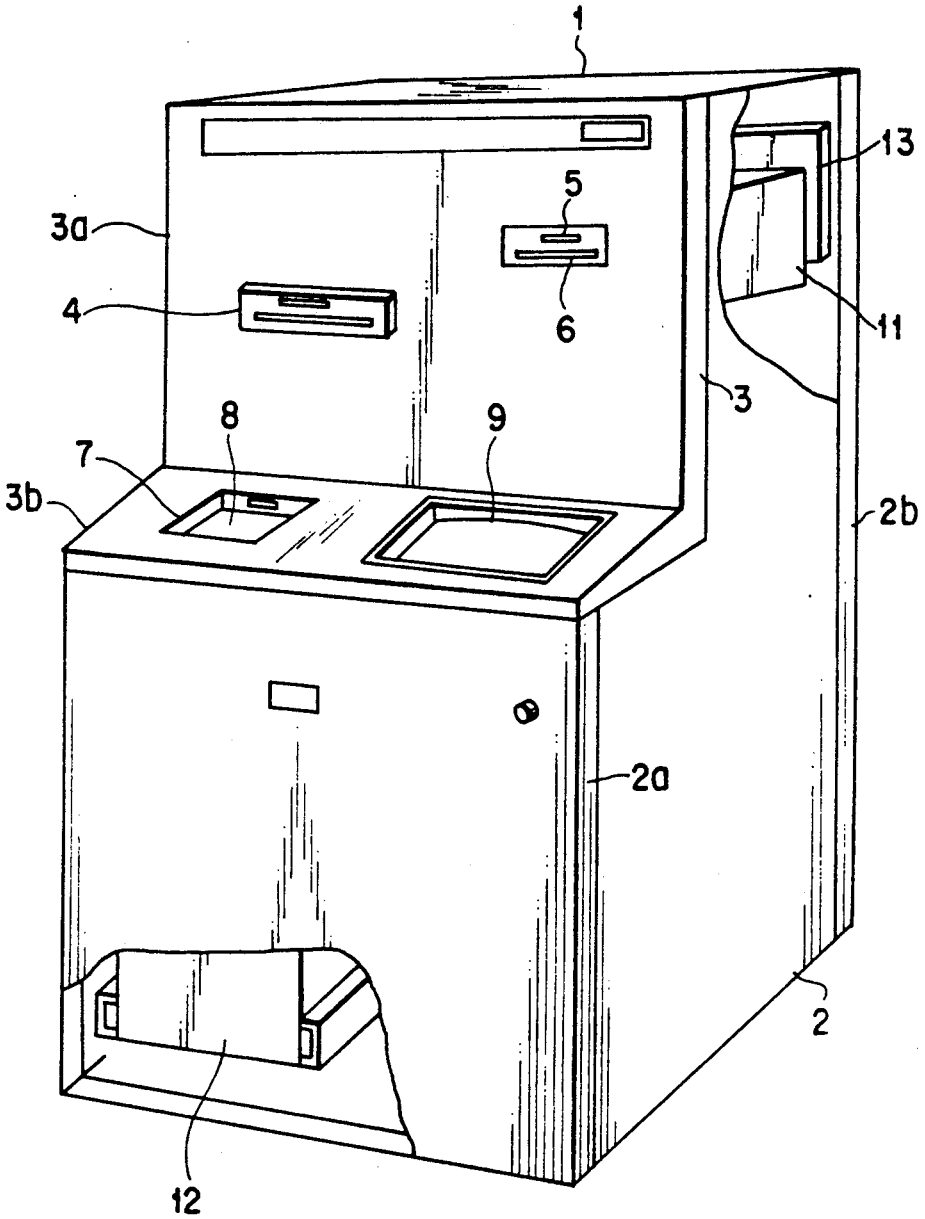
FIG. 4 is a view showing an outer appearance of an automatic teller machine incorporating a sheet stacking apparatus according to the present invention.

FIG. 4 shows an outer appearance of a circulation type automatic teller machine according to the present invention. Referring to FIG. 4, reference numeral 1 denotes an apparatus body.

The apparatus body 1 has an operation table 3 on a front surface of its housing 2. A passbook insertion port 4, a card insertion port 5, a slit issuance port 6, and the like are formed in a vertical operation panel 3*a* of the operation table 3.

A cash insertion/dispensing port 7 serving as both a cash insertion port and a cash dispensing port is provided in a horizontal operation panel 3*b* of the operation table 3. A shutter 8 is provided in the cash insertion/dispensing port 7 to be capable of being opened and closed.

A CRT (Cathode Ray Tube) display 9 incorporating a touch sensor is provided on the horizontal operation panel 3*b* of the operation table 3. An operation sequence and other information are displayed on the CRT display 9 in the form of illustrations, characters, or words to instruct the user how to use the automatic teller machine. When the user depresses a display portion of the display 9 corresponding to a password, an account number, an amount, confirmation or cancel of a transaction, or the like in accordance with the displayed guidance, a key-in operation is performed.

The housing 2 has a passbook reading/printing unit (not shown), a card/slip handling unit 11, a cash receiving/dispensing mechanism 12, and an internal monitor unit 13. The passbook reading/printing unit reads magnetic information from a passbook, upon reception of the passbook through the passbook insertion port 4, and prints transaction records and transaction content on the passbook. The card/slip handling unit 11 deals with a magnetic card inserted through the card insertion port 5, issues a slit through the slip issuance port 6, forms a journal copy, and the like. The cash receiving/dispensing mechanism 12 serves as a cash receiving/dispensing means having a banknote receiving/dispensing function, a forgotten banknote recovery function, a loading function, an inspection function, and the like.

Figure 5:
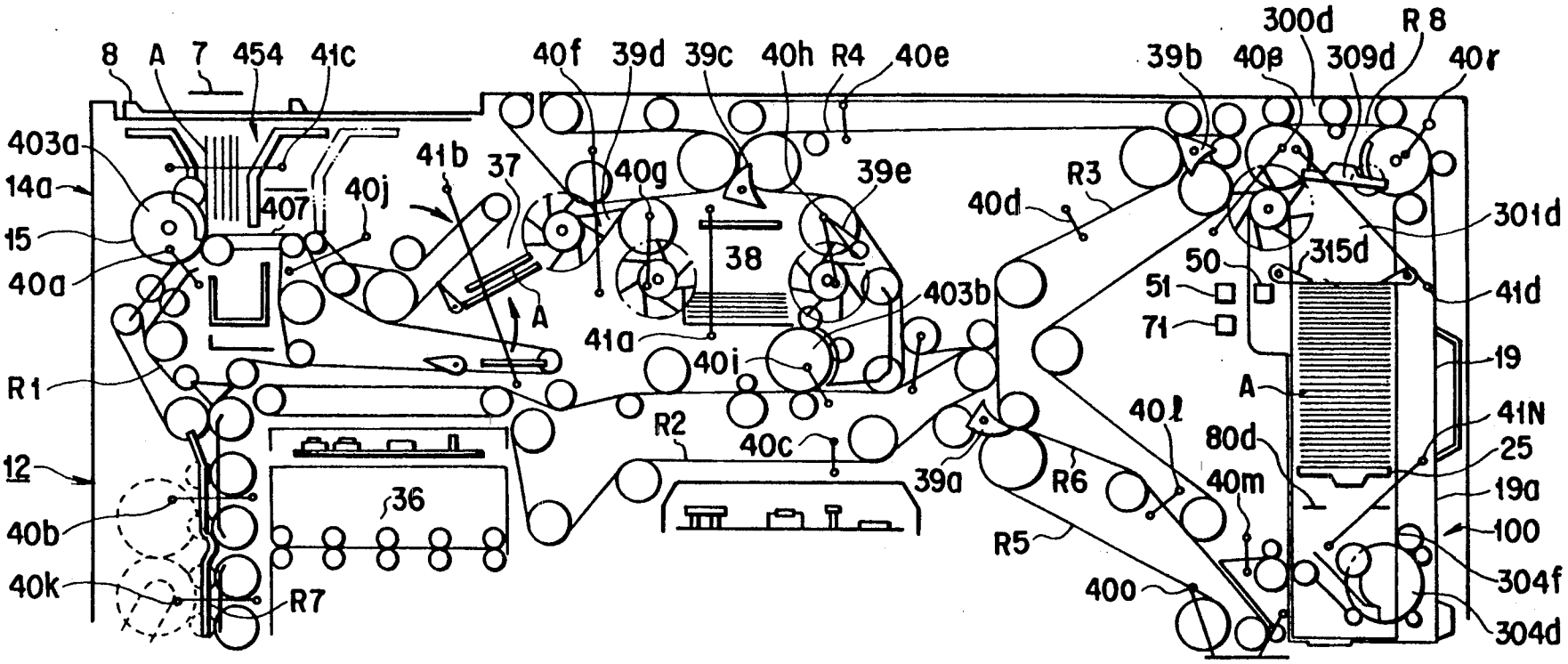
FIG. 5 is a schematic sectional view showing the structure of an upper unit of the automatic teller machine shown in FIG. 4.
Figure 6:
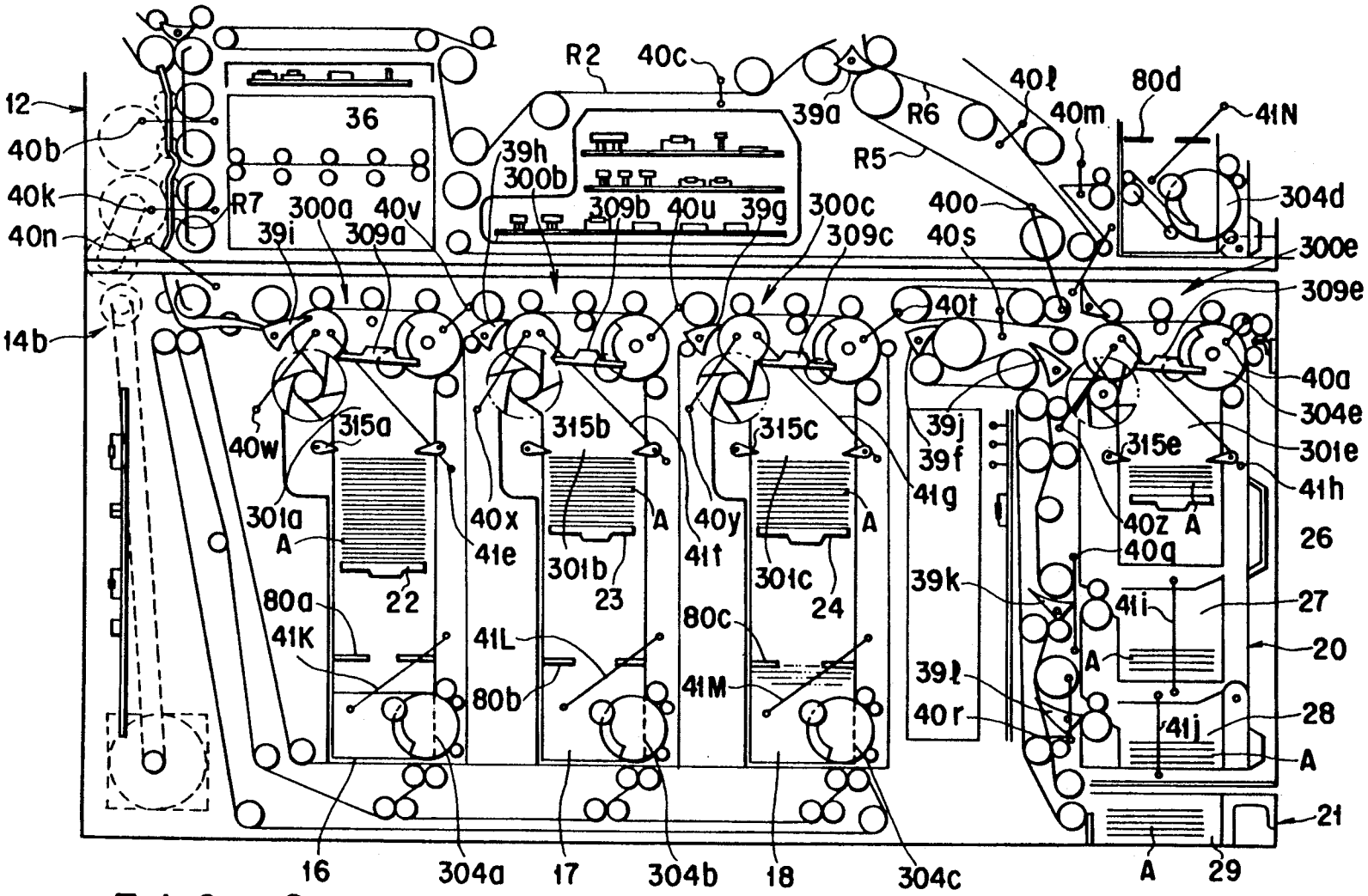
FIG. 6 is a schematic sectional view showing the structure of a lower unit of the automatic teller machine shown in FIG. 4.
Figure 7:
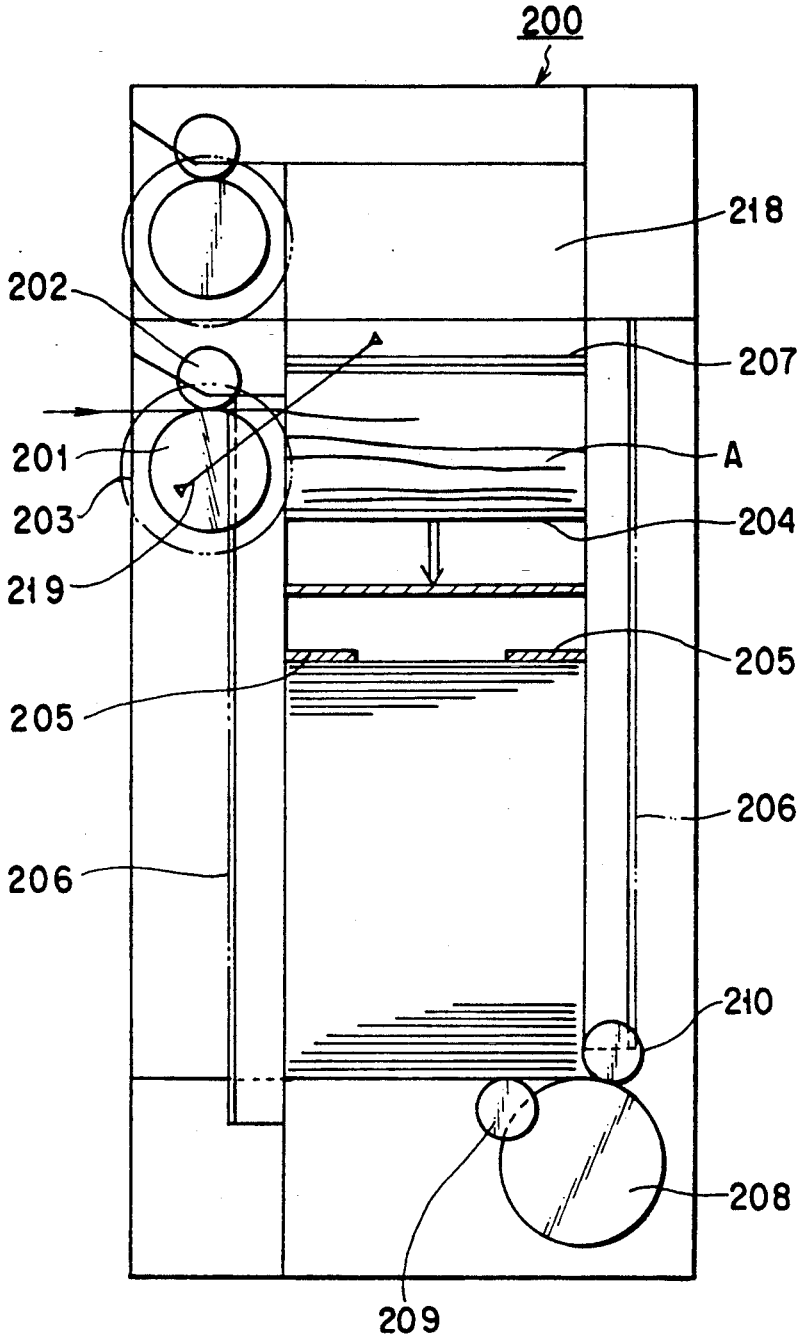
FIG. 7 is a view showing a stacking control state of the sheet stacking apparatus according to the present invention.
Figure 8:
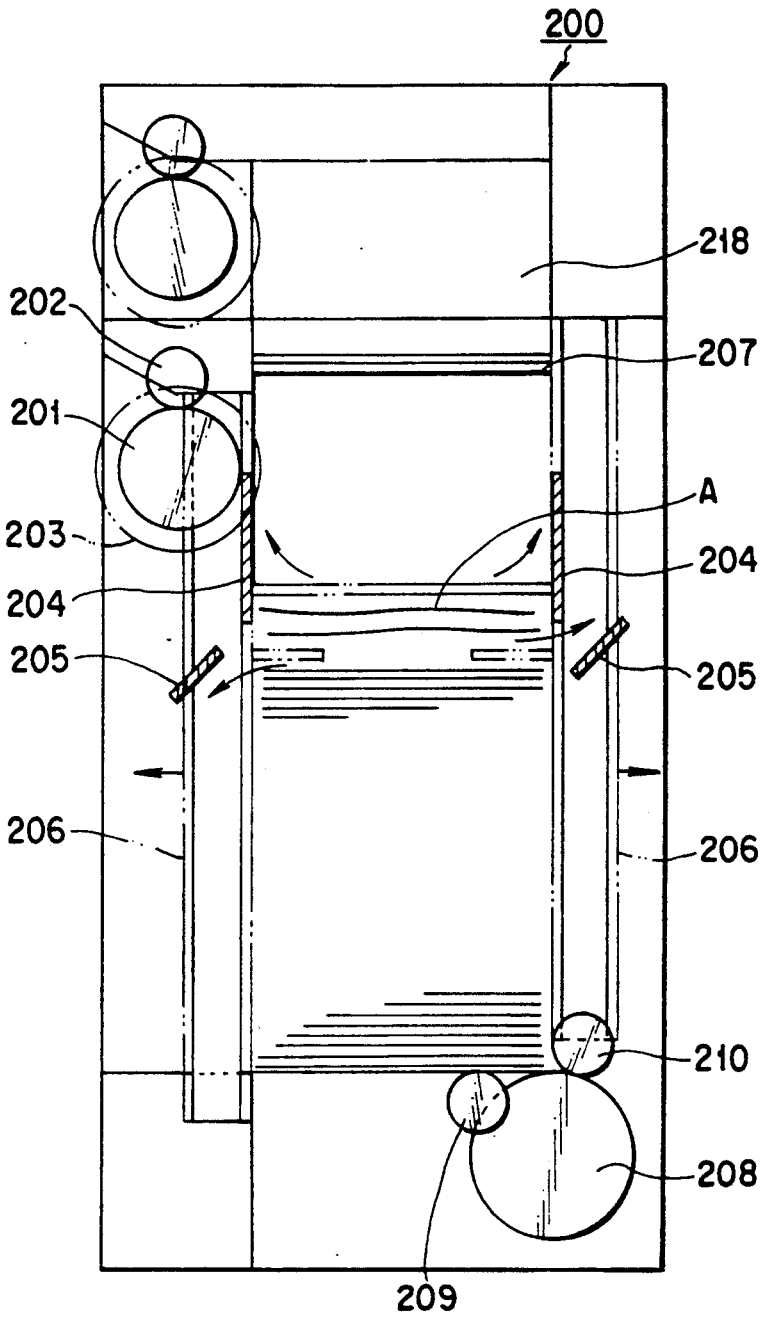
FIGS. 8 to 10 are views for explaining a banknote stacking operation in a stacking safe.

The cash receiving/dispensing mechanism 12 is constituted by upper and lower units 14*a* and 14*b*, as shown in FIGS. 5 and 6. Inside the upper unit 14*a*, a banknote reception/delivery unit 15 is provided in the upper portion of the front side (customer-facing direction) to correspond to the cash insertion/dispensing port 7 shown in FIG. 4.

A loader 19 serving as the first collective storing section is provided in the rear portion of the upper unit 14*a* to constitute a loaded banknote storing section for loading and storing the banknotes A.

In the lower unit 14*b*, safes 16, 17, and 18 in units of denominations serving as storing sections, and a reception safe 20 serving as the second collective storing section for storing appropriate dispensing banknotes, e.g., elimination banknotes like old banknotes or recovery banknotes are arranged.

Reference numeral 21 denotes a rejection safe for storing rejection banknotes, e.g., a counterfeit banknote or a non-inspectable banknote while the banknotes are to be loaded in the manner as will be described later.

First, second, third, fourth, and fifth stacking/delivery units 300*a*, 300*b*, 300*c*, 300*d*, and 300*e* are provided in the safes 16, 17, and 18 in units of denominations, the loader 19, and the reception safe 20, respectively.

Flaps 315*a* to 315*e* for defining spaces 301*a* to 310*e* as the stacking sections are provided in the stacking/delivery units 300*a* to 300*e*, respectively. Pusher plates 309*a* to 309*e* are disposed in the spaces 301*a* to 301*e*, respectively.

Reference numerals 22 to 26 denote shutters constituting shutter mechanisms (to be described later) provided in the safes 16, 17, and 18 in units of denominations, the loader 19, and the reception safe 20, respectively.

Reference numeral 36 denotes an inspection unit disposed at substantially the central portion along the vertical direction of the front side in the upper unit 14*a*. A temporary dispensing cash stacking section 37 and a temporary received cash stacking section 38 are provided on the right side of the inspection unit 36.

Banknote transport paths R (R1 to R8) are formed in the upper and lower units 14*a* and 14*b* constituting the cash receiving/dispensing mechanism 12. The banknotes A are transported to the respective portions via these banknote transport paths R1 to R8. First to twelfth sorting gates 39*a* to 39*l* driven by rotary solenoids (not shown) are disposed at the branching portions of the banknote transport paths R.

Banknote passage detectors 40*a* to 40*o*, 40*q* to 40*z*, and 40β and 40γ are arranged at portions midway along the banknote transport paths R, and banknote presence/absence detectors (remaining banknote check sensors) 41*a* to 41*j* are arranged at the respective stacking portions where the banknotes A are stacked. Each of the banknote passage detectors 40*a* to 40*o*, 40*q* to 40*z*, and 40β and 40γ; the banknote presence/absence detectors 41*a* to 41*e*, and 41*g* to 41*j*; and banknote presence/absence detectors 41K to 41N has a known structure including a light-emitting element and a light-receiving element.

The flow of the banknotes A in the arrangement as described above will be described. In the cash receiving operation, when a display portion of the CRT display 9 corresponding to "deposit" is depressed by the user, the main control unit is set in the cash acceptable state to output a cash reception command to the cash receiving/dispensing mechanism 12, and the shutter 8 of the cash insertion/dispensing port 7 is opened.

In this state, after the user places a bundle of banknotes A including different denominations with different sides facing upward in a banknote storage 454, the shutter 8 is closed.

When the closed state of the shutter 8 is detected, a floor 407 is vibrated up and down to align the banknotes A. A reception roller 403*a* is rotated to sequentially fetch the banknotes A one by one starting from the uppermost one.

The banknotes A fetched by the reception roller 403*a* are transported via the banknote transport path R1, and the number of received banknotes is counted from a detection output from the banknote passage detector 40*a*.

The received banknotes A are then guided to the inspection unit 36. The denomination (type of banknote), the authenticity, the obverse/reverse side, and the like of the banknotes A are discriminated.

A banknote A discriminated as an obverse-side transported upward through the first sorting gate 39*a* and via the transport path R3, and is guided to the transport path R4 by the second sorting gate 39*b*. The banknote A passing the transport path R4 is direction-switched by the third and fourth sorting gates 39*c* and 39*d* to be stacked in the temporary received cash stacking section 38.

At this time, a banknote A discriminated as a reverse-side banknote by the inspection unit 36 passes through the first and second sorting gates 39*a* and 39*b* and is direction-switched by the third sorting gate 39*c* to be inverted and stacked in the temporary received cash stacking section 38. In this manner, the obverse/reverse sides of the banknotes A can be aligned.

A banknote A discriminated as a rejection banknote by the inspection unit 36 is sent to and stacked in the temporary dispensing cash stacking section 37 through the first, second, third, and fourth sorting gates 39*a*, 39*b*, 39*c*, and 39*d*.

When all the banknotes A placed in the banknote storage 454 run out, the banknotes (rejection banknotes) A stacked in the temporary dispensing cash stacking section 37 are discharged into the banknote storage 454 in the form of a bundle. The shutter 8 is opened, and the rejection banknotes A are returned to the user.

When the user enters "confirmation" from the CRT display 9, a delivery roller 403*b* is rotated to fetch the banknotes A stacked in the temporary received cash stacking section 38 from the lowermost one. The fetched banknotes A are inspected by the inspection unit 36, direction-switched to downward by the first sorting gate 39*a*, and transported to the lower unit 14*b* via the transport path R5.

The safes 16, 17, and 18 in units of denominations are set to store, e.g., 10,000-yen notes, 1,000-yen notes, and 5,000-yen notes, respectively. A 10,000-yen note whose denomination is discriminated by the inspection unit 36 is transported horizontally via the sixth sorting gate 39*f*, direction-switched by the seventh, eighth, and ninth sorting gates 39*g*, 39*h*, and 39*i*, and stacked in the stacking section 301*a* of the safe 16 as the 10,000-yen note safe.

A 1,000-yen note whose denomination is discriminated by the inspection unit 36 is transported via the sixth and seventh sorting gates 39*f* and 39*g*, direction-switched by the eighth sorting gate 39*h*, and stacked in the stacking section 301*b* of the safe 17 as the 1,000-yen note safe.

A 5,000-yen note whose denomination is discriminated by the inspection unit 36 is transported through the sixth sorting gate 39*f*, direction-switched by the seventh sorting gate 39*g*, and stacked in the stacking section 30*ac* of the safe 18 as the 5,000-yen note safe.

Elimination banknotes, e.g., old banknotes, and rejection banknotes are direction-switched by the sixth sorting gate 39*f* and stacked in the stacking section 301*e* of the reception safe 30 through the tenth sorting gate 39*j*.

When all the banknotes A are stacked on the shutters 22, 23, 24, and 26 of the stacking sections 301*a*, 301*b*, 301*c*, and 301*e* in the respective safes 16, 17, 18, and 20, as described above, the stacked banknotes are pushed downward by the pusher plates 309*a*, 309*b*, 309*c*, and 309*e* disposed in the respective safes, and stopped by the flaps 315*a*, 315*b*, 315*c*, and 315*e* to be stored below them, thereby completing the cash receiving operation.

When the banknotes A are stacked in the temporary received cash stacking section 38, if an input signal corresponding to "disapproval" is input, the banknotes A in the temporary received cash stacking section 38 are returned to the banknote storage 454 and then the user by opening the shutter 8. When the banknotes A are removed from the banknote storage 454, the shutter 8 is closed.

Referring to FIG. 5, reference numeral 50 denotes a magnet incorporated in the loader 19. When the magnet 50 is mounted in a mounting portion 100 of the upper unit 14*a* of the apparatus body 1, its setting state can be detected by a lead switch 51 provided to the mounting portion 100.

The flow of the banknotes A in the cash dispensing operation will be described. When a withdrawal transaction is selected and sequentially an amount of withdrawal is input, the stored banknotes A in the lower portions of the safes 16, 17, and 18 are urged by upper press plates 80*a* to 80*c* so that they are brought into contact with delivery rollers 304*a* to 304*c*, and the banknotes A are thus taken out one by one.

In this case, 10,000-yen notes, 1,000-yen notes, and 5,000-yen notes are taken out one by one from the safes 16, 17, and 18, respectively, by rotating the corresponding delivery rollers 304*a* to 304*c*, transported forward in the horizontal direction, direction-switched in the upper direction to be guided to the upper unit 14*a* via the transport path R7, and transported to the inspection unit 36.

A banknote A discriminated as an authentic note by the inspection unit 36 is stacked in the temporary dispensing cash stacking section 37 through the first, second, third, and fourth sorting gates 39*a*, 39*b*, 39*c*, and 39*d*.

When the banknotes A having a predetermined withdrawal amount are stacked in the temporary dispensing cash stacking section 37, cash delivery from the safes 16, 17, and 18 is stopped, and the banknotes A stacked in the temporary dispensing cash stacking section 37 are discharged into the banknote storage 454 in the form of a bundle. Simultaneously, the shutter 8 is opened and the banknotes A are dispensed to the user.

When the user removes the dispensed banknotes A, the shutter 8 is closed, thus completing the withdrawal transaction.

The flow of the banknotes A in a received cash returning operation will be described. In the cash receiving operation, after the banknotes A are stacked in the temporary received cash stacking section 38, when a cancellation command is input and displayed on, e.g., the CRT display 9, the banknotes A are discharged into the banknote storage 454 in the form of a bundle and returned to the user by opening the shutter 8. When the user removes the banknotes A from the banknote storage 454, the shutter 8 is closed again.

The flow of a forgotten banknote recovery operation is as follows. While the shutter 8 is open, if the user does not remove the dispensed banknotes A from the banknote storage 454 after a lapse of a predetermined period of time, the shutter 8 is closed, and the banknotes A in the banknote storage 454 are fetched into the apparatus 1 one by one.

The banknotes A fetched in this manner are sent to a recovery box 27 or 28 in the reception safe 20 through the inspection unit 36 and the first, sixth, and tenth or eleventh sorting gates 39*a*, 39*f*, and 39*j* or 39*k*, and are stacked there and recovered.

The flow of the banknotes A in a loading (replenishing) operation for a holiday unmanned operation will be described. Before the holiday, a door 19*a* provided on the rear surface of the loader 19 to be openable and removable is unlocked by the person in charge to open the door 19*a* backward or remove the door 19*a*, and banknotes A are set in the loader 19.

After the banknotes A are set in this manner, the door 19*a* is closed and locked, and a banknote loading mode is selected by the person in charge, thereby starting the unmanned loading operation of the banknotes A.

More specifically, the banknotes A are fetched by a delivery roller 304*d* of the loader 19 one by one, and transported through the second, third, and fifth sorting gates 39*b*, 39*c*, and 39*e* to be guided to the inspection unit 36, so that their denomination and the like are discriminated.

The banknotes A discriminated by the inspection unit 36 are transported downward through the first sorting gate 39*a* and sent through the eleventh and sixth sorting gates 39*k* and 39*f*.

In this case, 1,000-yen notes passing through the seventh sorting gate 39*g* are direction-switched by the eighth sorting gate 39*h* and stacked in the stacking section 301*b* of the 1,000-yen note safe 17. 10,000-yen notes passing through the seventh sorting gate 39*g* are direction-switched by the ninth sorting gate 39*i* and stacked in the stacking section 301*a* of the 10,000-yen note safe 16.

5,000-yen notes passing through the sixth sorting gate 39*f* are direction-switched by the seventh sorting gate 39*g* and stacked in the stacking section 301*c* of the 5,000-yen note safe 18. The banknotes A are urged into and stored in the corresponding stacking/storing sections in this manner.

A banknote A discriminated as a note to be rejected by the inspection unit 36 during loading is guided upward by the first sorting gate 39*a* and returned to the loader 19 through the second and third sorting gates 39*b* and 39*c*, or stacked in the temporary dispensing cash stacking section 37.

When the rejection note is to be stacked in the temporary dispensing cash stacking section 37, it sometimes overlaps a note (loading note) delivered from the loader 19 and passed through the second sorting gate 39*b* on the transport path R4 between the second and third sorting gates 39*b* and 39*c*. Hence, when a rejection note is found, cash delivery is stopped instantaneously, and resumed after the rejection note passes along the transport path R4. Alternatively, the delivered note (loading note) and the rejection note are transported together as they overlap each other, and are stacked in the temporary dispensing cash stacking section 37. When the banknotes A in the loader 19 run out, the banknote loading operation for the holiday unmanned operation is completed.

When rejection notes are found, they are transported to the banknote storage 454 from the temporary dispensing cash stacking section 37, and fetched one by one by the reception roller 403*a* to be inspected by the inspection unit 36. The rejection notes whose denomination is discriminated by the inspection unit 36 are guided to the lower unit 14*b* by the first sorting gate 39*a* and stored in the safes 16, 17, and 18 in accordance with their denominations.

A rejection note which is rejected again by the inspection unit 36 is guided downward by the first sorting gate 39*a*, and stacked and stored in a recovery box 29 of the rejection safe 21 through the sixth, tenth, eleventh, and twelfth sorting gates 39*f*, 39*j*, 39*k*, and 39*l*.

The flow of the banknotes A in a scrutinizing operation will be described. A 10,000-yen banknote A which is delivered from the 10,000-yen note safe 16 is transported to the lower unit 14*b* via the transport path R7 and transported to the inspection unit 36 to be inspected.

The banknote A inspected by the inspection unit 36 is guided to the transport path R5 by the first sorting gate 39*a* and transported to the lower unit 14*b* to be returned to the 10,000-yen note safe 16.

This operation is repeated until the remaining banknote check sensor 41K detects that the banknotes A under the shutter 22 run out.

In this case, when a rejection note that cannot be inspected by the inspection unit 36 is found, it is stacked in the recovery box 29 of the rejection safe 2 through the sixth, tenth, eleventh, and twelfth sorting gates 39*f*, 39*j*, 39*k*, and 39*l*, and recovered.

The efficiency of the loading or inspecting operation of the banknotes A in handling a large number of banknotes, as described above, is a very important factor in the automatic teller machine of this type.

In the embodiment of the present invention, the safes 16 to 18 and the loader 19 are arranged such that they can simultaneously receive and deliver the banknotes A and can continuously stack the banknotes A corresponding to the total capacities of the respective safes without cessation.

Conventionally, when banknotes are to be loaded in an automatic teller machine of this type, for example, the banknotes corresponding to the total capacity of each safe are loaded by repeatedly stacking 100 banknotes and transferring the 100 stacked banknotes to another storing place. When a scrutinizing operation is to be performed, all the banknotes of the safes are counted while being transferred to the loader, and are returned from the loader to the respective safes. These operations require a long time. In contrast to this, according to the present invention, the operation time is largely saved by adopting the arrangement to be described later.

FIGS. 7 to 22 schematically show changes occurring in the sheet stacking apparatus according to the present invention for explaining the internal operations of the safes 16 to 18 and the loader 19. Referring to FIGS. 7 to 22, reference numeral 200 denotes an apparatus body.

In the apparatus body 200, the banknotes A sequentially transported from the transport paths of the automatic teller machine 1 described above are sandwiched between a conical roller 201 and a pinch roller 202 to be stacked on a shutter 204 constituting the shutter mechanism.

The conical roller 201 straightens the banknote A by sandwiching it with the pinch roller 202, thus preventing the banknote A from being bent upon abutting against two side walls 206 of the apparatus body 200.

A striker wheel 203 having a plurality of flexible radial blades mounted thereon is coaxially mounted on the conical roller 201 so as to be rotatable in synchronism with the conical roller 201. The striker wheel 203 urges downward the trailing ends of the banknotes A stacked on the shutter 204 to maintain a housing space for a banknote A to be transported next.

Referring to FIGS. 7 to 22, reference numerals 205 denote a pair of upper press plates (corresponding to upper press plates 80*a*, 80*b*, and 80*c* in FIG. 4), disposed below the shutter 204 to be spaced apart from each other, for urging the uppermost surface of the stacked banknotes A. The upper press plates 205 urge the uppermost surface of the stored or uncounted banknotes A stacked on the inner bottom portion of the apparatus body 200 to prevent the banknotes that tend to roll or have wrinkles from floating.

The shutter 204 is movable in a direction perpendicular to the sheet surface of the banknote A. When a shutter descent detection sensor 219 serving as a detecting means provided in the vicinity of the conical roller 201 detects that a sufficient space is not reserved in the safe for a banknote to move into the safe, the shutter 204 is controlled to move downward to reserve the sufficient space for the banknote, thereby achieving stable banknote stacking.

When transportation of the banknote A is stopped, the shutter 204 is moved downward until it is detected by a descent position detecting means (not shown) at a predetermined distance above the upper press plates 205. Then, the shutter 204 and the upper press plates 205 are pivoted in the open direction to drop the banknotes A stacked on the shutter 204 on the banknotes A stacked below the upper press plates 205.

At this time, the side walls 206 of the apparatus body 200 are urged by the shutter 204 to be moved outwardly by a distance corresponding to the thickness of the shutter 204, thereby facilitating dropping of the banknotes A.

Figure 9:
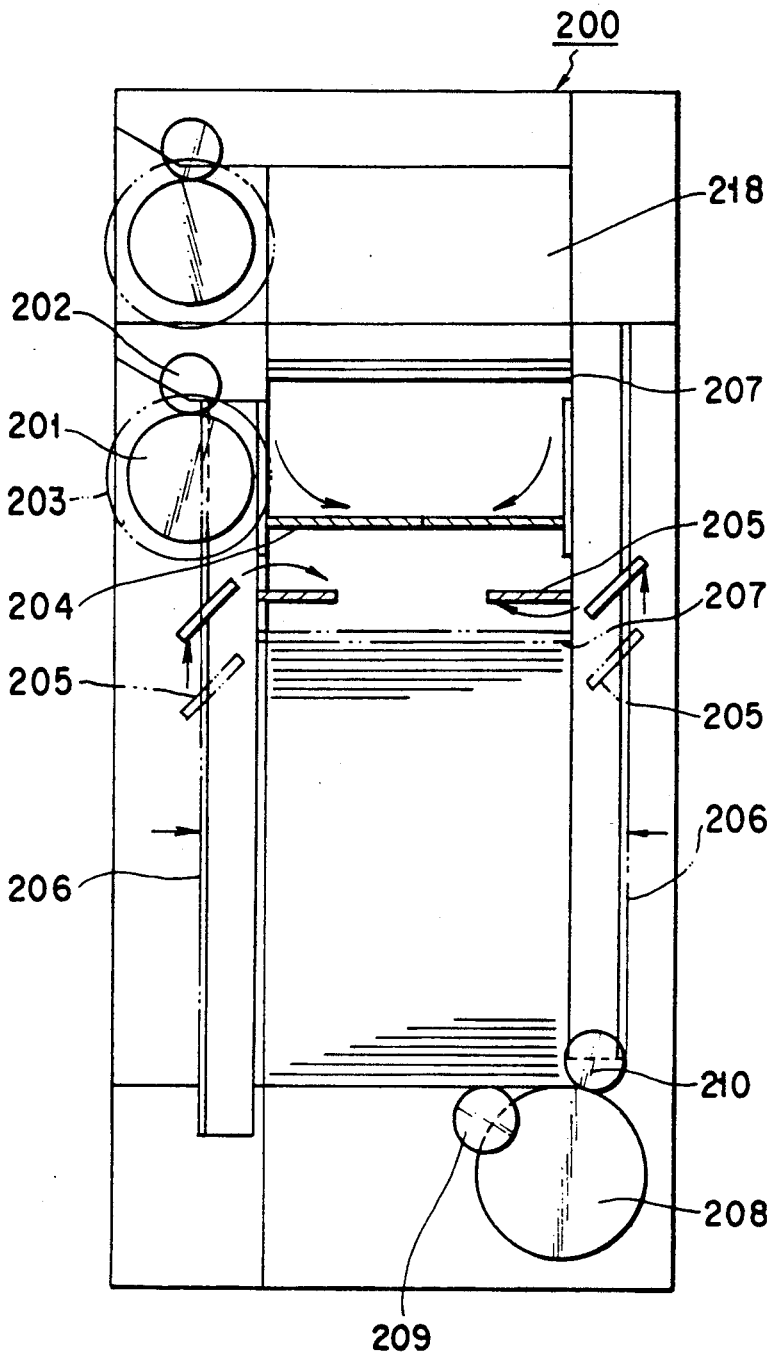

When the banknotes A stacked on the shutter 204 are dropped in this manner, a pusher 207 provided above the shutter 204 to be vertically movable is moved downward, as shown in FIG. 9 to urge the banknotes A stacked below the upper press plates 205.

In this state, the shutter 204 and the upper press plates 205 are moved upward to the uppermost pivot positions while they are kept open. At this time, the pusher 207 is also returned to the home position. Then, the shutter 204 and the upper press plates 205 are pivoted in the closing direction to be returned to the original state, and the side walls 206 of the apparatus body 200 are also returned to the original state.

Figure 10:
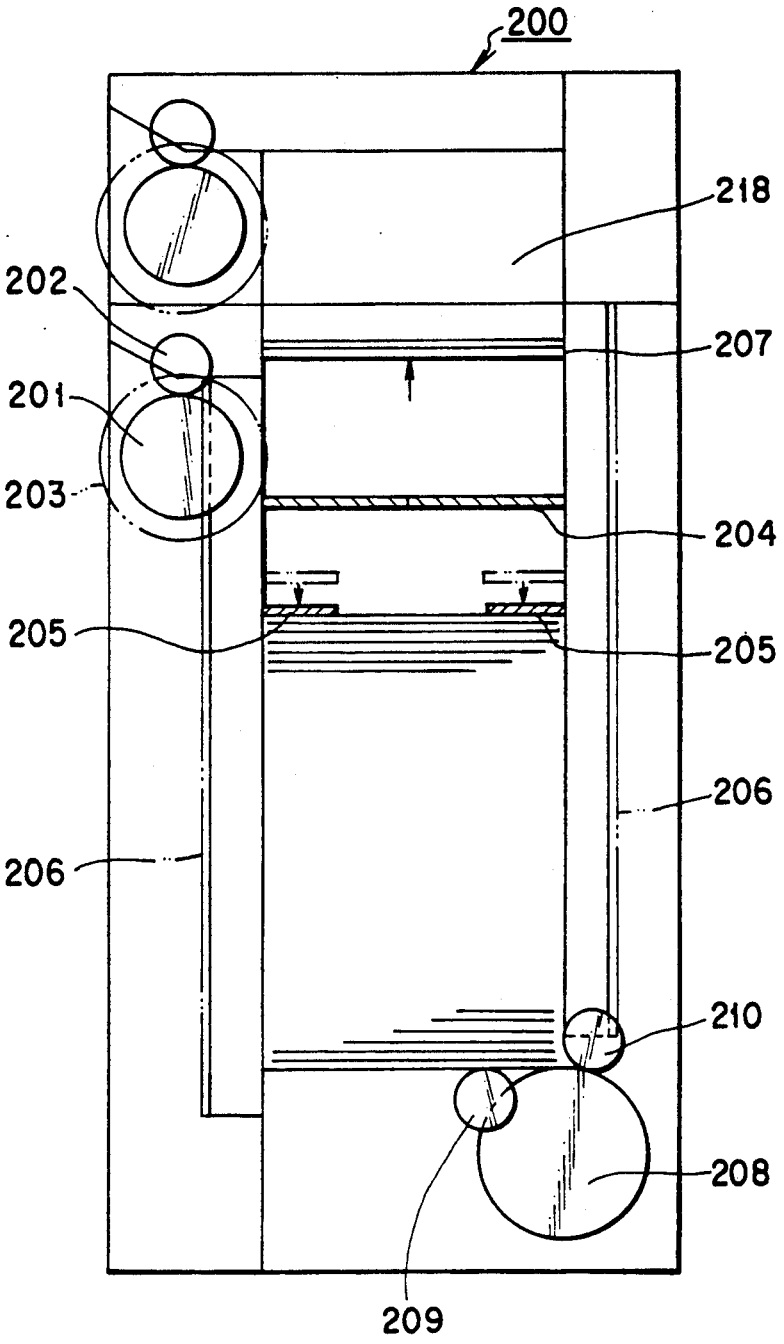

In this manner, when the shutter 204 and the upper press plates 205 are moved to the uppermost positions to be returned to the original closed state, the upper press plates 205 are moved downward to urge the banknotes A, as shown in FIG. 10.

Figure 11:
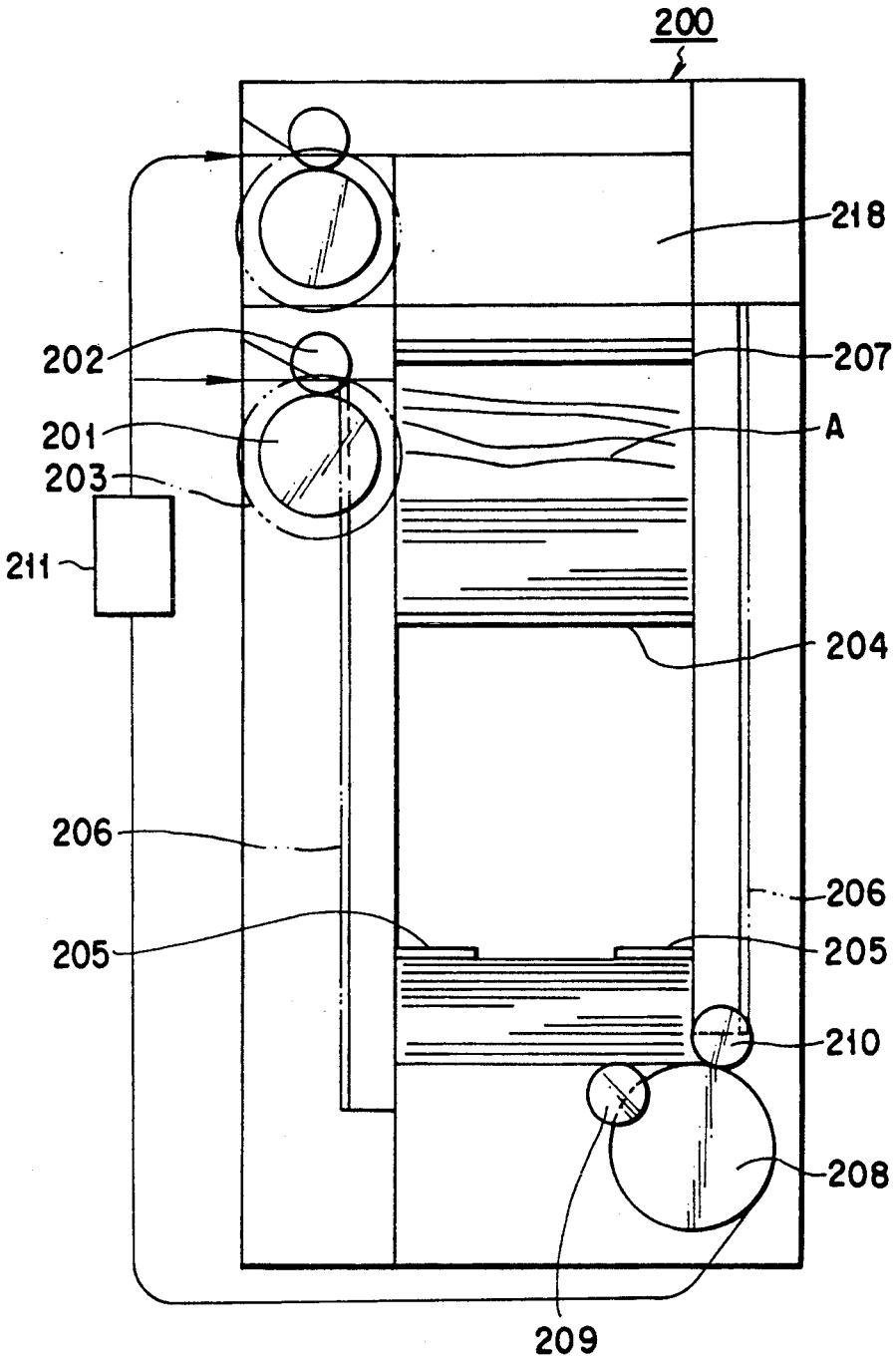
FIGS. 11 to 14 are views for explaining an operation of confirming the number of banknotes discharged from the stacking safe without stopping the continuous stacking operation.

An operation will be described in which the number of banknotes discharged from the stacking safe can be confirmed without stopping the continuous stacking operation. FIGS. 11 to 14 show counting operations of the banknotes A stacked in the apparatus body 200. As shown in FIG. 11, the banknotes A are separately delivered one by one from the lower portion of the apparatus body 200 through a feed roller 208, a pickup roller 209, and a gate roller 210, counted and denomination-discriminated by an inspection unit 211, and thereafter sequentially stacked on the shutter 204. At this time, a banknote that cannot be inspected is stored in a rejection safe 218 provided in the upper portion of the apparatus body 200.

In this case, when the banknotes A are to be separately delivered one by one, they can be stably delivered by the friction force generated with respect to the feed roller 208 by their own weight until the number of remaining banknotes reaches a certain value. However, if the number of remaining banknotes reaches the certain value or less, the banknotes cannot be stably delivered since they are lightweight.

Figure 12:
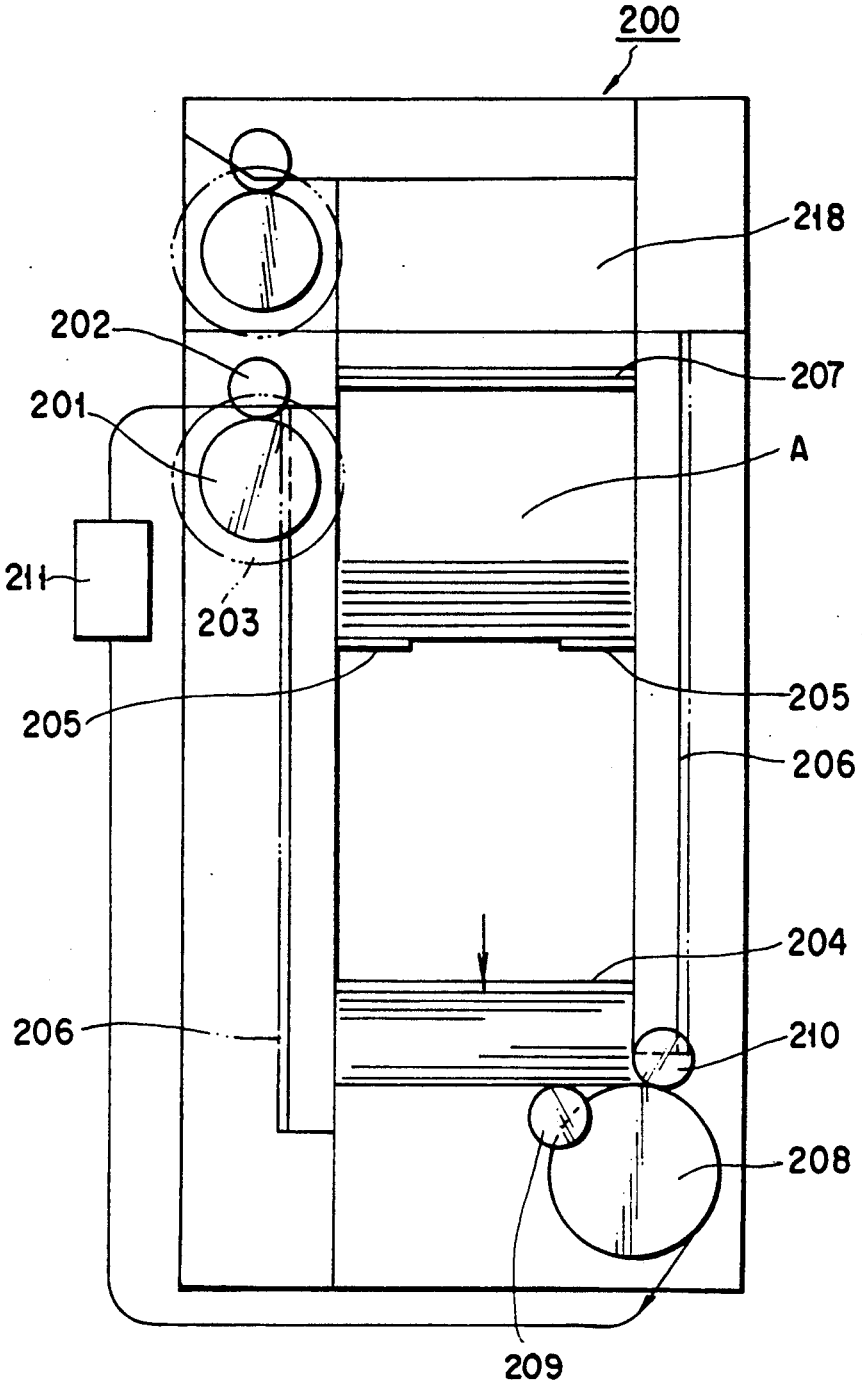

Nevertheless, since the upper press plates 205 can urge the upper surface of the stacked banknotes A only partially as they are provided apart from each other, as shown in FIG. 12, the banknotes A cannot be constantly delivered.

In order to solve this problem, according to the present invention, when the number of stacked banknotes A is decreased to a certain value or when the uppermost surface of the stacked banknotes is lowered to a certain position, the upper press plates 205 are moved upward passing the shutter 204 to support the counted banknotes A that have been stacked on the shutter 204.

Figure 13:
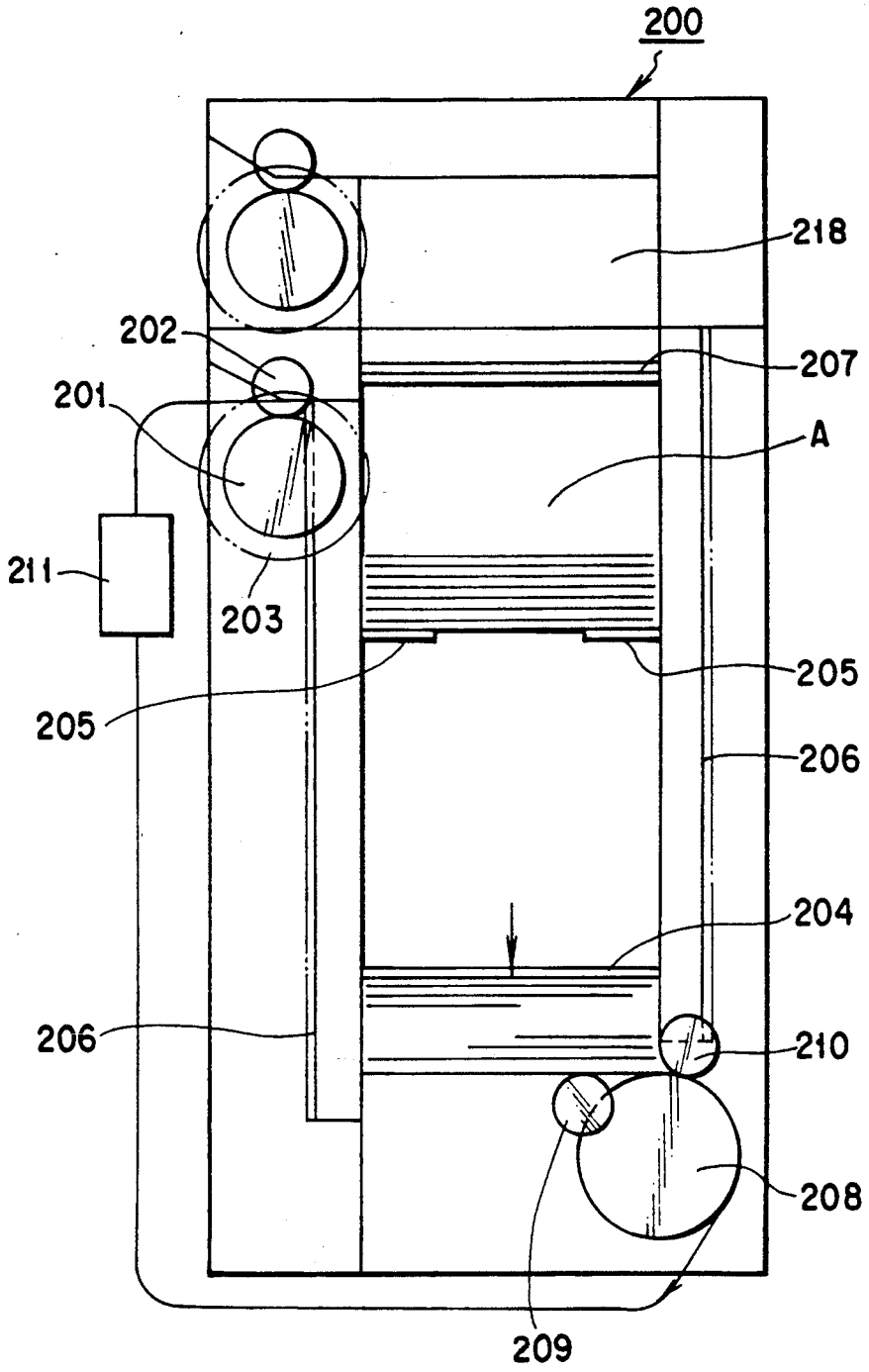
Figure 14:
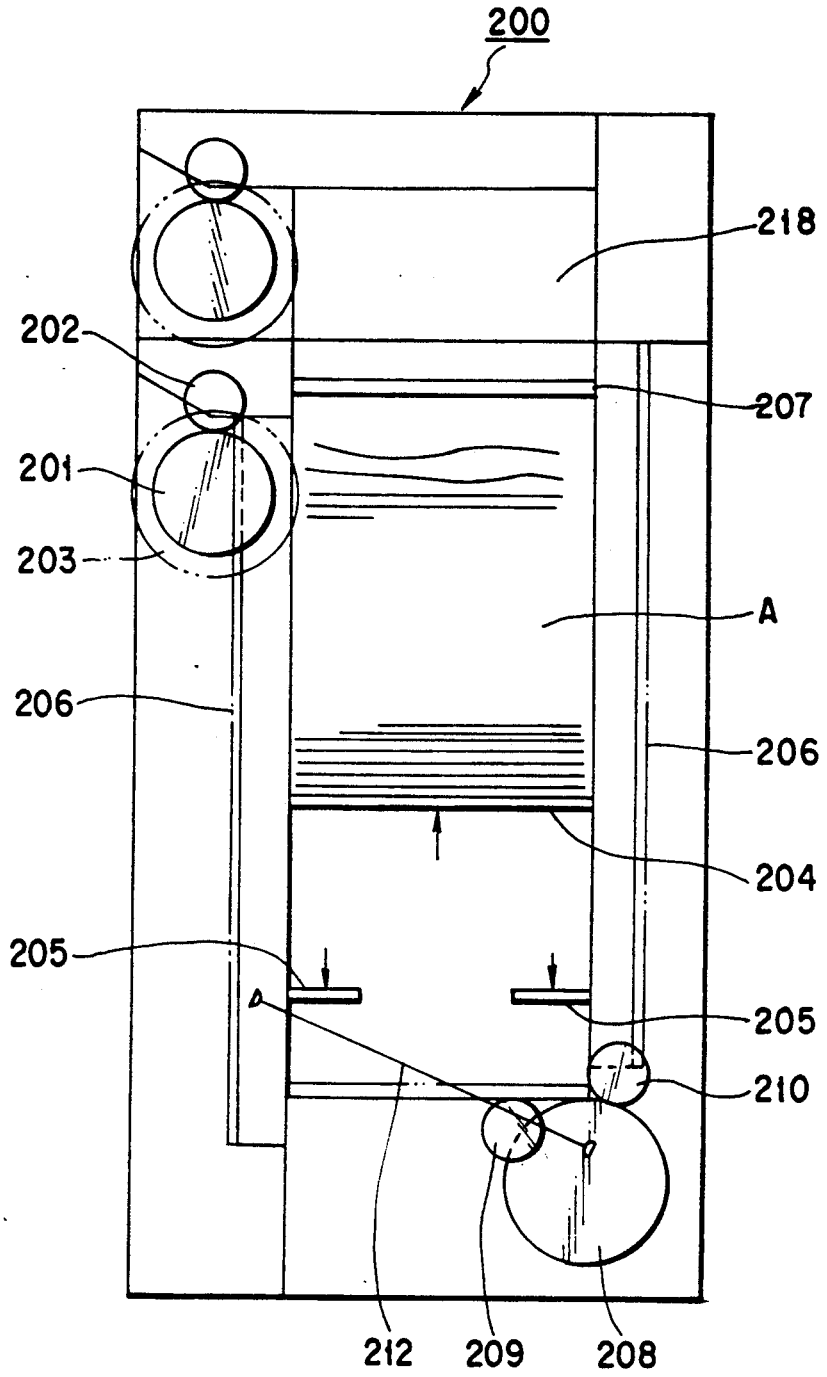

In this state, when the shutter 204 is moved downward to urge the uppermost surface of the remaining uncounted banknotes A, as shown in FIG. 13, the banknotes A can be continuously stably delivered. As a result, the entire mechanism can be simplified. This banknote delivering operation is completed, as shown in FIG. 14, when a remaining banknote detection sensor 212 provided at a lower portion of the apparatus body 200 detects that no banknote is remained, thus completing the counting operation.

An operation of controlling the shutter 204 will be described with reference to FIGS. 15 to 20.

Figure 15:
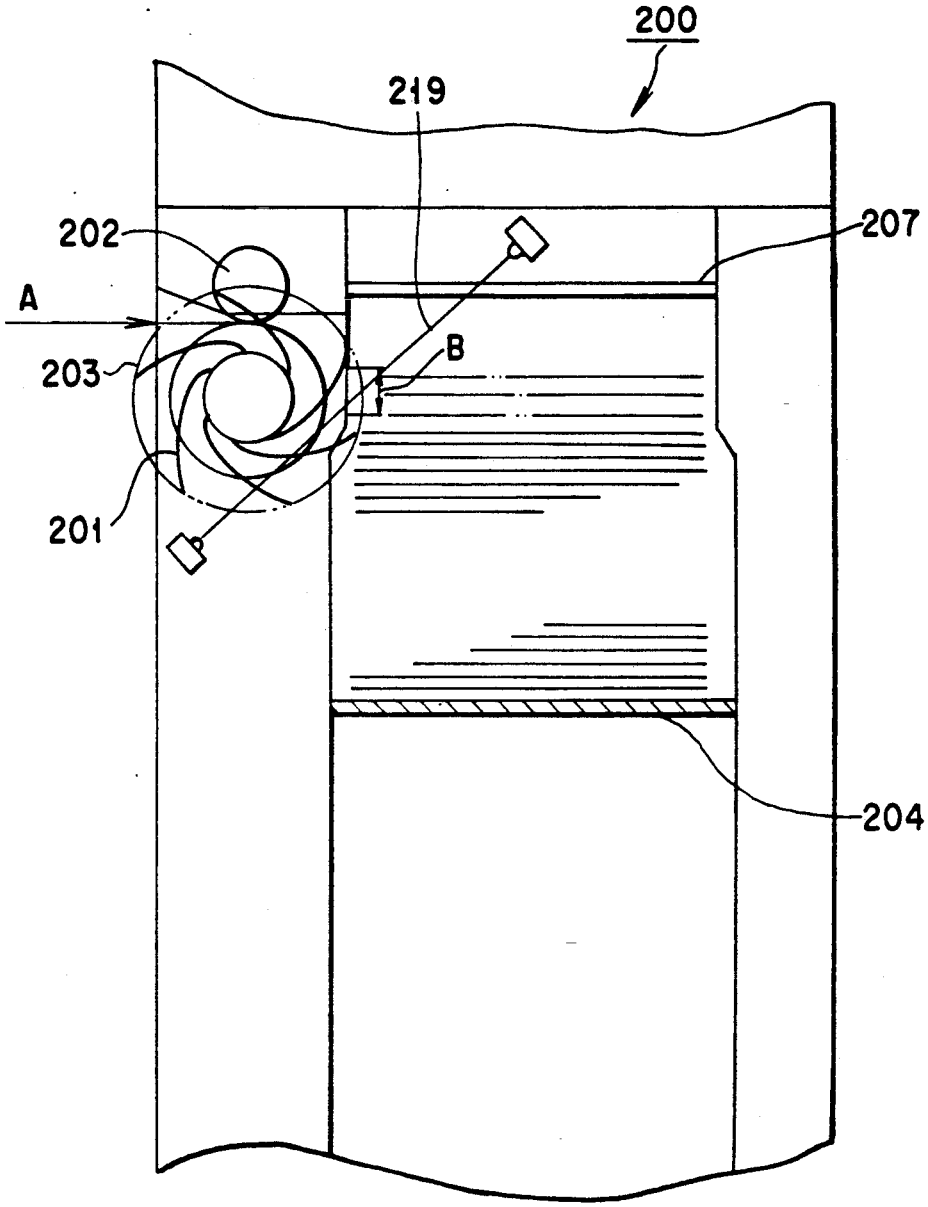
FIGS. 15 to 18 are views for explaining an operation of a sheet detection sensor for lowering a shutter.

That is, when the banknotes A are sequentially stacked on the shutter 204, as shown in FIG. 15, the striker wheel 203 urges the trailing ends of the banknotes below the striker wheel 203 downward to reserve a housing space for the banknotes A until the uppermost surface of the stacked banknotes A reaches a position corresponding to a certain count. At this time, an output from the shutter descent detection sensor 219 has a waveform as indicated by the timing chart shown in FIG. 19.

When further banknotes A are to be loaded, the striker wheel 203 can no longer urge the banknotes A, and banknotes A are stacked over a forcing position B where the uppermost surface of the stacked banknotes A urged by the striker wheel 203 normally reaches at most, as indicated by a one-dot-dashed line in FIG. 15.

Figure 16:
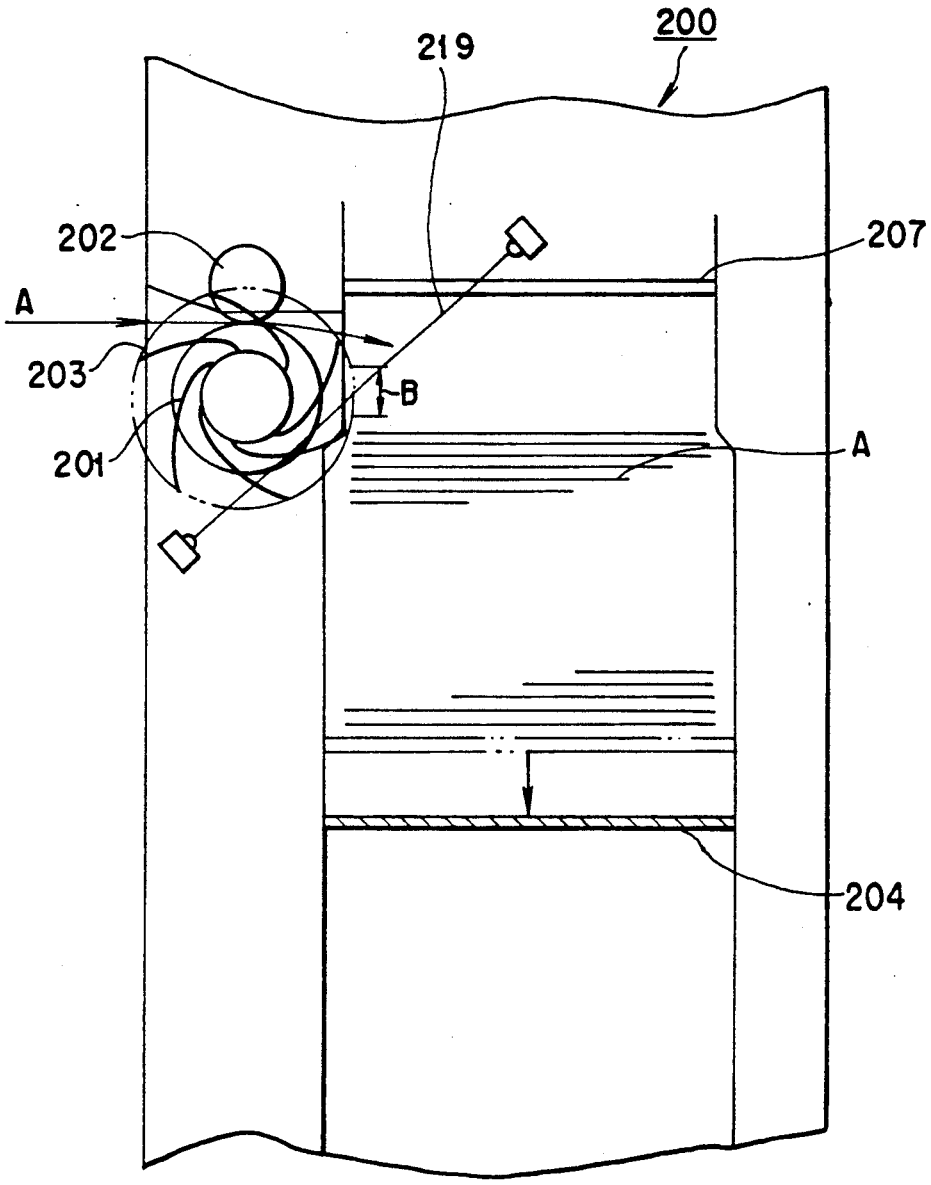
Figure 20:
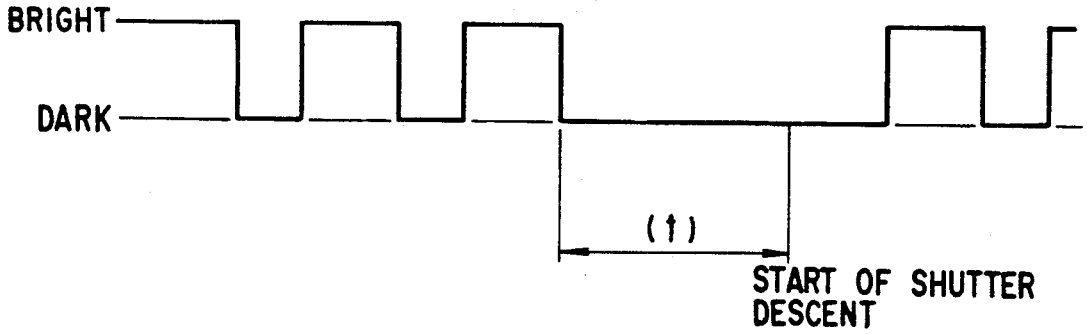
FIG. 20 is an output waveform chart showing an output when the sheet detection sensor detects stacked sheets.

Then, the uppermost one of the stacked banknotes A blocks the optical axis of the shutter descent detection sensor 219, and the output from the sensor 219, that indicates the stacking position of the banknotes A on the shutter 204 to instruct the shutter 204 to move down, becomes as shown in the timing chart shown in FIG. 20. When a output corresponding to the dark period continues over a predetermined time period t, the shutter 204 is moved downward, as shown in FIG. 16, to restore the output from the shutter descent detection sensor 219 to have the waveform as shown in the timing chart of FIG. 19. When these operations are sequentially repeated, the banknotes A that are continuously loaded can be stably stacked.

Figure 17:
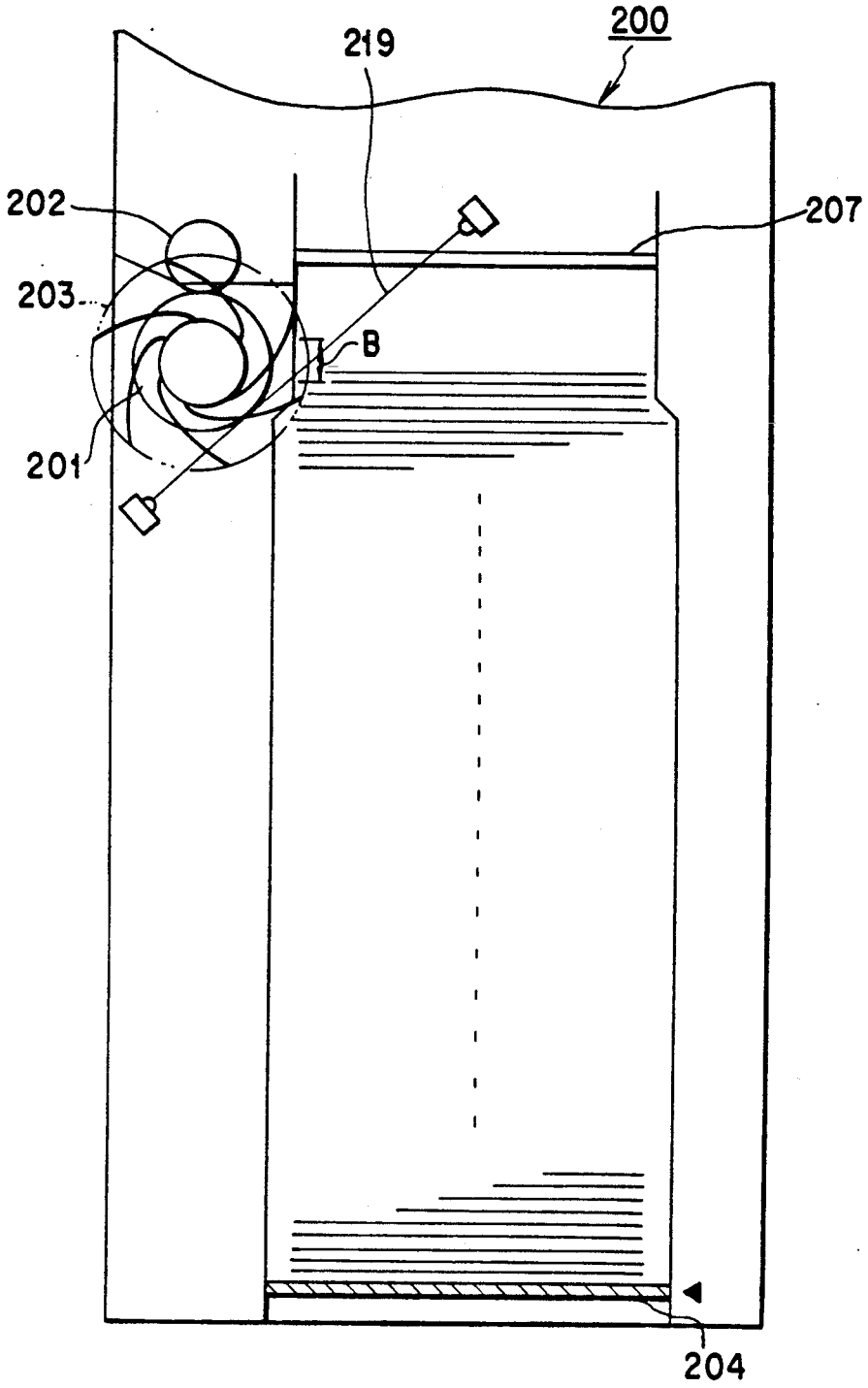

When the shutter 204 is moved downward to its lowermost position, as shown in FIG. 17, the shutter 204 is detected by a shutter lower end position detection sensor (not shown), and an output from the shutter descent detection sensor 219 is set to have a waveform as shown in the timing chart of FIG. 20, thereby stopping loading of the banknotes A.

Figure 18:
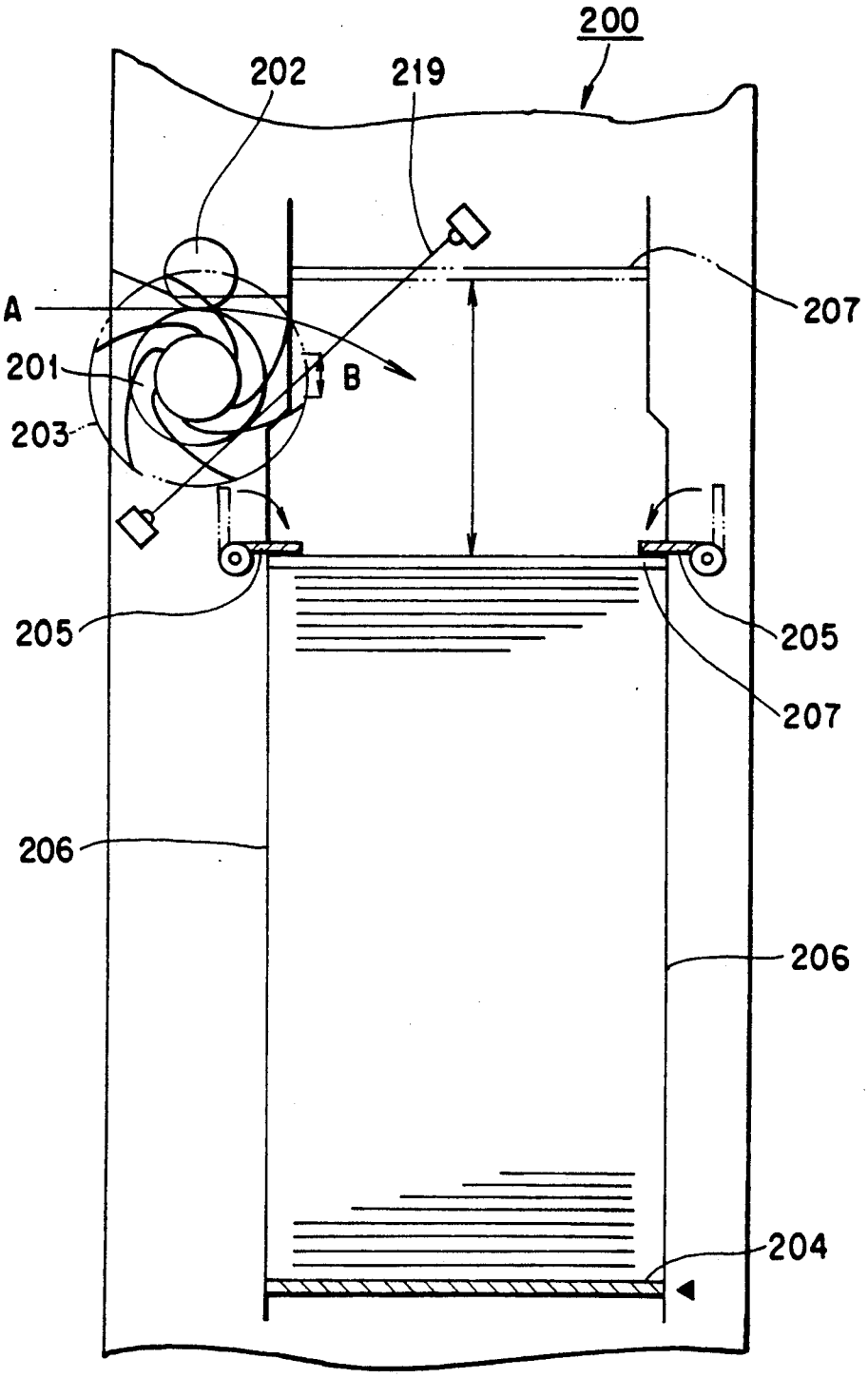
Figure 19:
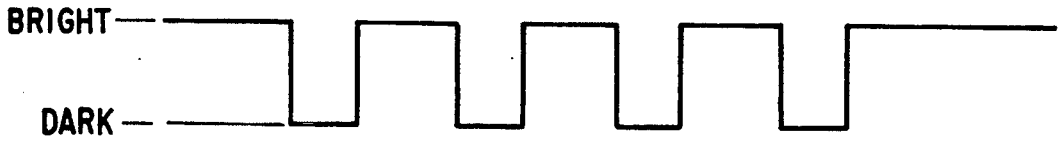
FIG. 19 is an output waveform chart showing an output when the sheet detection sensor does not detect stacked sheets.

At this time, the upper ones of the banknotes A stacked on the shutter 204 are unstable as they are not urged. Hence, the pusher 207 is moved downward passing the support positions of the upper press plates 205, as shown in FIG. 18, to urge the upper surface of the banknotes A stacked on the shutter 204. Then, the upper press plates 205 are pivoted in the closing direction to urge the uppermost surface of the banknotes A, thereby reserving a housing space for a next banknote A to follow. In this manner, loading of the next banknote A is enabled.

With the arrangement of the present invention described above, banknotes A corresponding to the total capacity of the apparatus body 200 can be handled in accordance with continuous stacking. If the quality of the banknotes is poor and a stacking count is decreased unless the banknotes are urged, the banknotes are efficiently handled up to an intermediate step in accordance with continuous stacking, and after that the uppermost surface of the banknotes stacked on the shutter 204 is controlled by being urged by the pusher 207 to obtain a correct stacking count. As a result, the handling efficiency is improved as well as the stacking time and the storage space.

In the embodiment of the present invention, the gap between the two side walls 206 of the apparatus body 200 is formed small at the upper portion and large below a certain position, as shown in FIGS. 15 to 18.

More specifically, when the banknotes A transported into the upper portion of the banknote body 200 are to be aligned and moved downward by decreasing the friction between the side walls 206 of the apparatus body 200 and the banknotes A in the lower portion of the apparatus body 200, the urging force of the banknotes stacked on the shutter 204 onto the feed roller 208 is set constant to improve the banknote delivery performance.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A sheet stacking apparatus comprising:

stacking means, having a sheet loading port and a sheet discharge port, for stacking a plurality sheets between the sheet loading port and the sheet discharge port;

pickup means for picking up one sheet from the plurality of sheets and discharging it through the sheet discharge port;

convey means for conveying the discharged sheet to the sheet loading port;

counting means for counting a number of sheets conveyed by the convey means;

separation means, disposed inside the stacking means, for separating the plurality of sheets stacked by the stacking means from a plurality of newly loaded sheets which are loaded through the sheet loading port, and for stacking the newly loaded sheets;

detection means for detecting a position of the newly loaded sheets stacked by the separating means; and means for moving the separation means in a stacking direction in accordance with the detection results of the detection means, thereby allowing the sheets stacked on the separation means to be unchanged in position;

sheet detection means, located proximate to the sheet discharge port, for detecting whether one of the plurality of sheets stacked by the stacking means remains on the stacking means during a sheet stacking operation, and for outputting a signal for stopping the pickup means and the counting means when the sheet detecting means detects that none of the plurality of sheets stacked by the stacking means remains on the stacking means.

* * * * *